US005908136A

United States Patent [19]

Mrak

[11] Patent Number: 5,908,136

[45] Date of Patent: Jun. 1, 1999

[54] DISPENSING CONTAINER

[75] Inventor: Stanley A. Mrak, Decatur, Ga.

[73] Assignee: Smith Container Corporation, Forest Park, Ga.

[21] Appl. No.: 08/989,708

[22] Filed: Dec. 12, 1997

[51] Int. Cl.[6] ..... B65D 23/00

[52] U.S. Cl. ..... 220/756; 220/771

[58] Field of Search ..... 220/771, 756

[56] References Cited

U.S. PATENT DOCUMENTS

| | | | |
|---|---|---|---|
| 4,928,860 | 5/1990 | Knight | 220/771 |
| 5,366,101 | 11/1994 | Krall et al. | 220/771 |

OTHER PUBLICATIONS

Photographs of a container which is identified as being made for Spectrum Group SG, Division of United Industries Corporation, P. O. Box 15842 St Louis, Missouri 63114, depicting the front view, back view, top view, left view and right view of the packaging container 1994.

*Primary Examiner*—Joseph M. Moy

*Attorney, Agent, or Firm*—Troutman Sanders LLP; Gerald R. Boss, Esq.

[57] ABSTRACT

A container for containing and dispensing articles having a unitary body having a center of gravity when full. A handle as integrally formed within the body and offset from the body to define a void. The handle encircles the center of gravity of the unitary body when the unitary body is full of contained articles.

2 Claims, 6 Drawing Sheets

DISPENSING CONTAINER

BACKGROUND OF THE INVENTION

TECHNICAL FIELD

This invention relates to a dispensing container in general, and in particular to a dispensing container for containing and dispensing large quantities of fluid or granular particles having a handle integrally formed within the container which encircles the center of gravity of the container when the container is full providing a mechanical advantage assisting in the dispensing of packaged articles while also providing a mechanical advantage when the container is less than full.

Many containers have been created for containing fluids and granular particles for dispensing. A handle provides the means for lifting and tilting the container. However, generally, the handle is not advantageously located to provide an optimum mechanical advantage to the user when the container is both full and partially full.

For large containers containing large quantities of fluid or granular items, the containers are very heavy and difficult to operate. In general, the fluid or granular particles are intended to be dispensed which requires the container to be lifted and carried to the ultimate dispensing point and rotated such that the fluid or granular articles may flow from the package design. However, the handle is typically merely suited for positioning of the hand and is not constructed for assisting the user in dispensing the fluid or granular particles. A design of such a dispensing container is illustrated by FIGS. 2A, 2B, 4A and 4B which is a container distributed by United Industries Corporation of St. Louis, Mo. This container has a handle with a center above the center of gravity of the container when the container is full and also partially full. Such a design while useful for its intended purpose, does not provide a satisfactory degree of mechanical advantage for assisting a user in dispensing the contained articles. Such assistance would aid users, such as elderly individuals, who have difficulty manipulating the heavy containers.

Accordingly, it is an object of the present invention to provide an elongated handle for providing maximum mechanical advantage for rotating a container for dispensing when the container is full or partially full.

Also, it is an object of the present invention, to provide a container having a handle which enables the user to position the grasp of the container at a point located around the center of the gravity of the container when the container is full for assisting the user in dispensing articles;

Furthermore, it is an object of the present invention to provide a container having a handle which enables the user to position the grasp of the container at a point located around the center of the gravity of the container when the container is full which also has a central position which is also in vertical proximity to the center of gravity of the container when the container is only partially filled for providing a mechanical advantage for dispensing articles.

SUMMARY OF THE INVENTION

A container for containing and dispensing articles having a unitary body having a center of gravity when full. A handle as integrally formed within the body and offset from the body to define a void. The handle encircles the center of gravity of the unitary body when the unitary body is full of contained articles.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF PREFERRED EMBODIMENT

Figure 1:
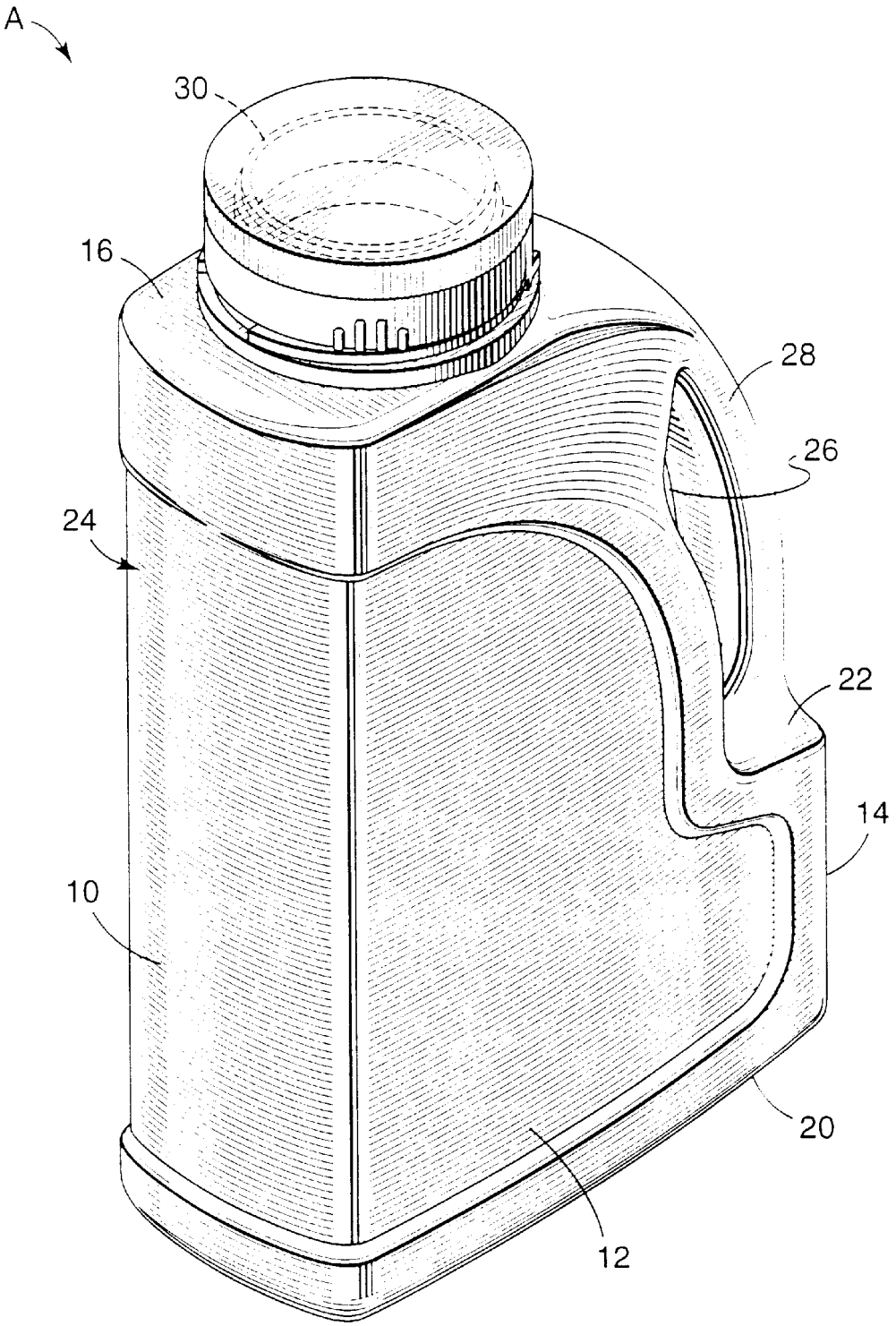
FIG. 1 illustrates a front right side perspective view of a dispensing container according to the present invention.

Referring now in more detail to the drawings, the invention will now be described in more detail. As generally shown in FIGS. 1, 6–11 dispensing container A is designed for containing a large quantity of items which may either be fluid or granular particles. The preferred capacity will equate to five pounds of contained items. Dispensing container A includes a generally planar front side 10, right side 12 which is generally perpendicular to front side 10, back side 14 which is disposed rearwardly from front side 10 and which is generally perpendicular to right side 12, top side 16 and bottom side 20. The left side of the container is not shown, but is a mirror image of right side 12.

Figure 7:
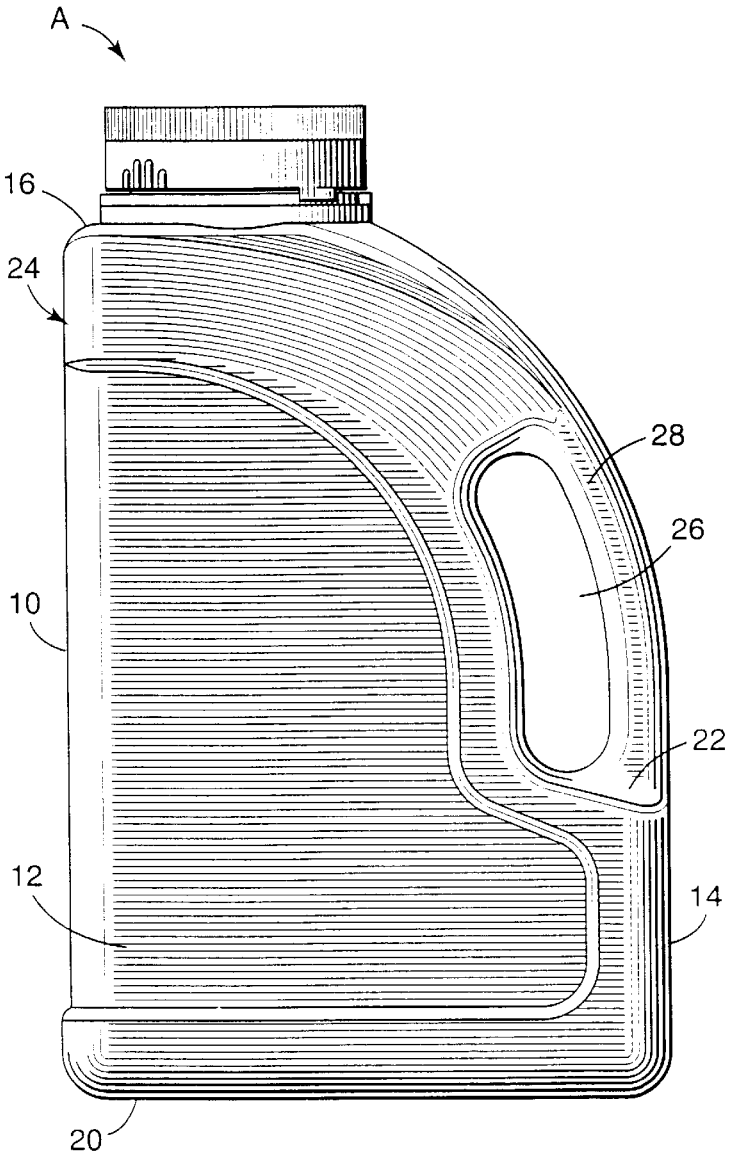
FIG. 7 illustrates a right side view of a dispensing container according to the present invention.
Figure 8:
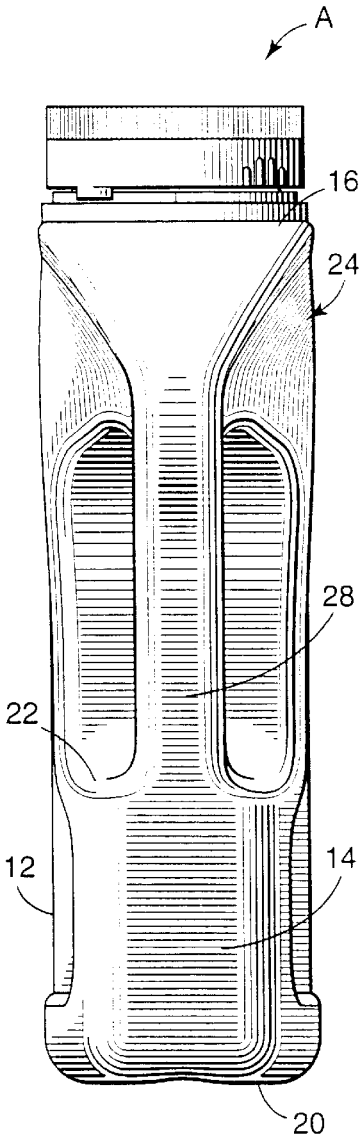
FIG. 8 illustrates a back view of a dispensing container according to the present invention.
Figure 9:
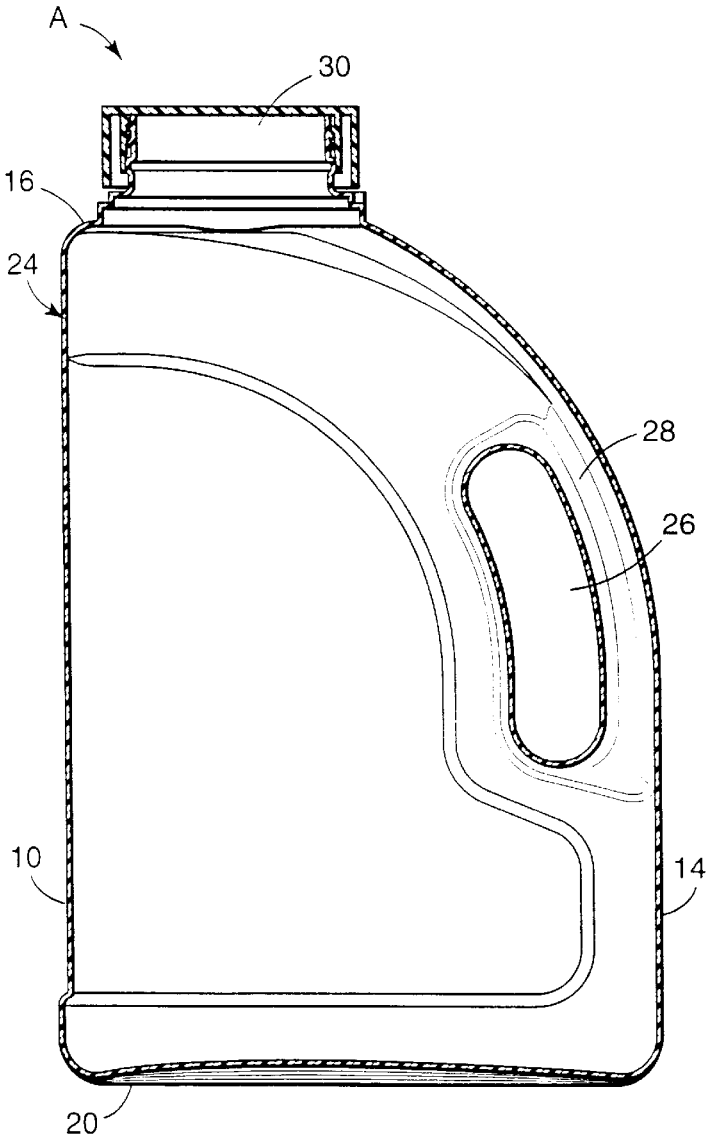
FIG. 9 is a sectional view of a dispensing container according to the present invention taken along line 9—9 of FIG. 6.
Figure 10:
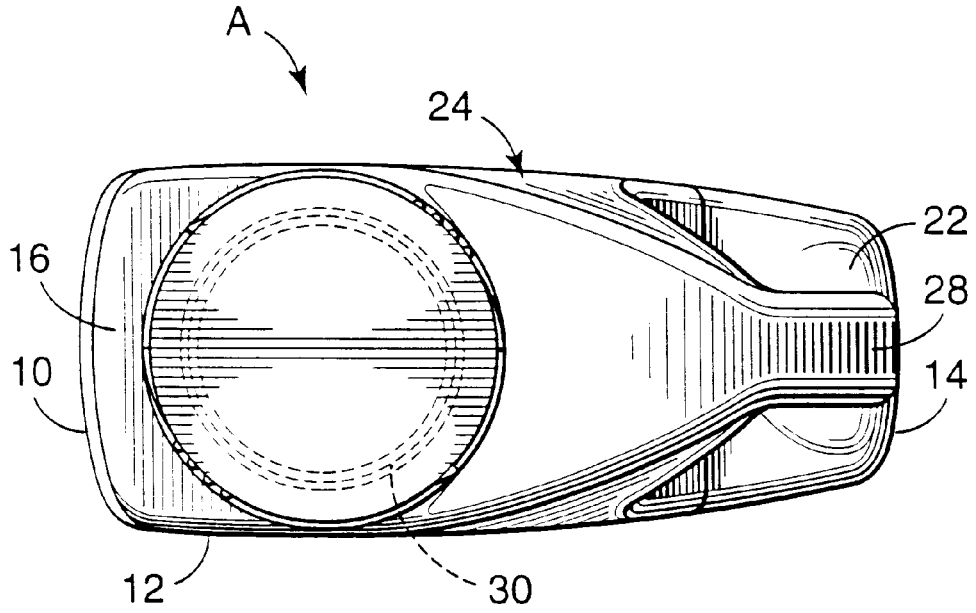
FIG. 10 is a top view of a dispensing container according to the present invention.
Figure 11:
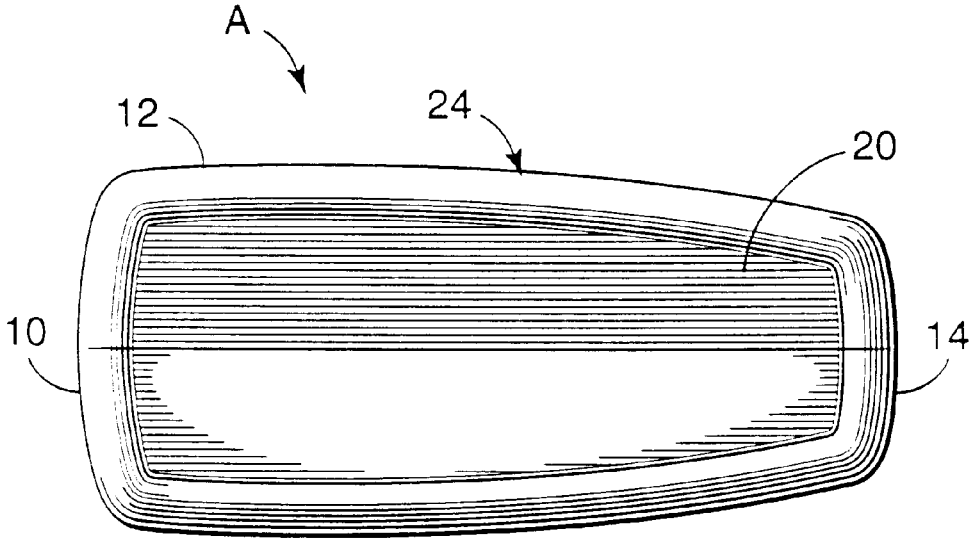
FIG. 11 is a bottom view of a dispensing container according to the present invention.

As shown in FIGS. 1, 7, and 9, back side 14 is curved from top side 16 to bottom side 20. Handle ridge 22 is located generally parallel to bottom side 20 a general distance above bottom side 20. Back side 14 is offset from the primary body container 24 to define void 26 and form handle 28.

The dimensional construction of container A is important to provide an advantageous mechanical advantage when the container is full and when it is partially filled. The general height of container A is eleven and a half inches from bottom side 20 to the top of pouring spout 30 and ten and a third inches from bottom side 20 to top side 16 which defines the storage area of container A. The distance from front side 10 to back side 14 is approximately seven inches. The width of container A is generally three and a quarter inches from the left and right side.

Primary container body 24 is offset from handle 28 approximately one inch. Handle 28 is approximately three and three quarter inches long extending upward from handle ridge 22.

The relationship of handle 28 with respect to the remaining portion of container A is critical to the invention. The top portion of handle 28 as defined by the top portion of void 26 starts at a height approximately two and five eights inches from top side 16. The handle may be arcuate and extends for approximately three and three quarter inches downward terminating at handle ridge 22. Handle ridge 22 where handle 28 terminates is approximately three and a half inches above bottom side 20. Handle 28 is generally six eighths of an inch wide. Accordingly, void 26 is approximately one inch wide and extends three and three quarter inches down towards the base of container A in an arcuate manner.

The advantage of the handle design with this void construction is that the handle provides a mechanical advantage when the container is full and at equilibrium and when it is less than full and at equilibrium such that minimal effort is required to dispense the contained items from the container. While the dimensions of the present invention are important, it should be appreciated that variances of approximately a half an inch either positively or negatively may be incorporated.

A comparison of container A with the known prior art is illustrated in FIGS. 2A–5B. These figures illustrate the mechanical advantage of handle 28.

Figure 2A:
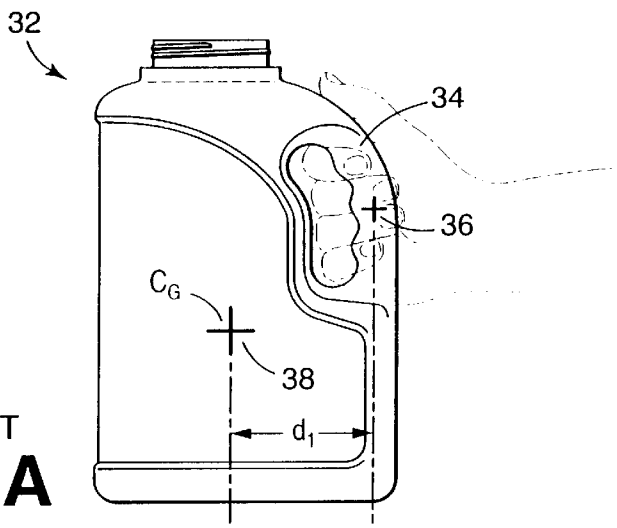
PRIOR ART FIG 2A
FIG. 2A illustrates a prior art container in an upright position when the container is full.
Figure 2B:
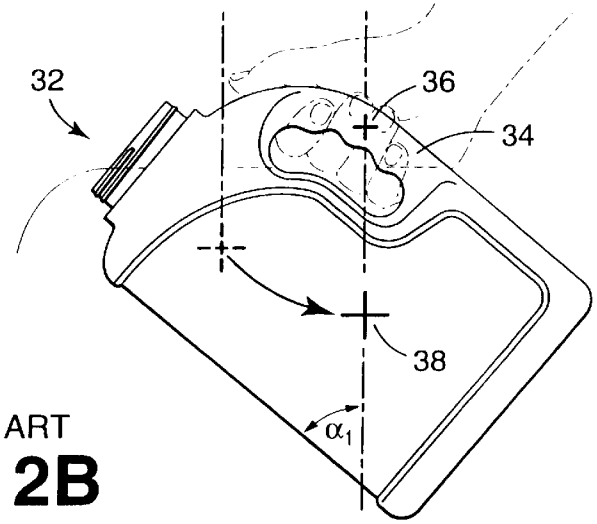
PRIOR ART FIG 2B
FIG. 2B illustrates a prior art container in an equilibrium position when the container is full.

FIG. 2A illustrates a prior art container 32 when full and in an upright position. The center of handle 34 is designated by cross 36. The center of gravity of this container when full is designated by CG cross 38. The lateral distance between these centers is designated by d1 which is approximately four and a half inches. FIG. 2*b* illustrates the equilibrium state when prior art container 32 is rotated such that the center of gravity of the container is vertically aligned with the center of handle 34. Angle alpha one illustrates the tilting of prior art container 32 in this equilibrium position. Angle alpha one is approximately forty-nine degrees. As is evident, further work is required by the person to rotate the container at a position where contained items may be dispensed.

Figure 3A:
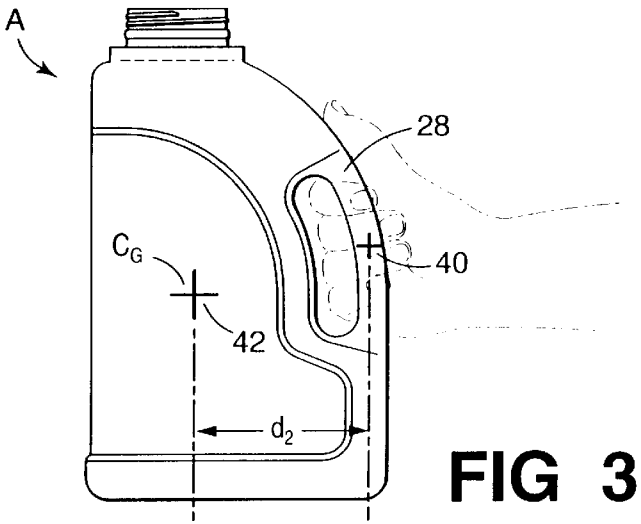
FIG. 3A illustrates a dispensing container according to the present invention in an upright position when the container is full.
Figure 3B:
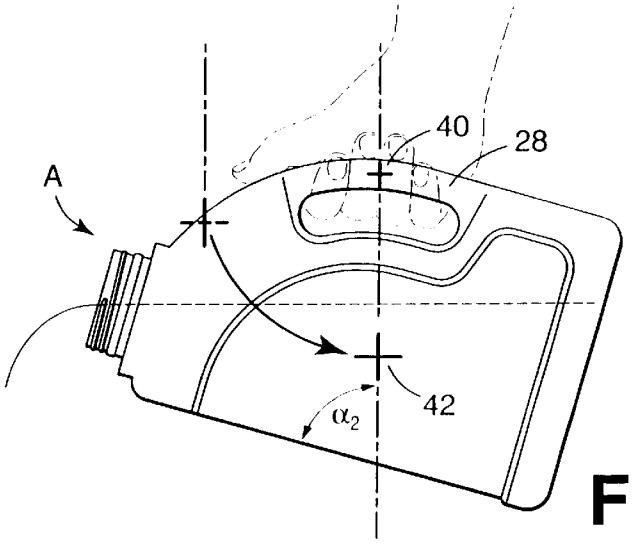
FIG. 3B illustrates a dispensing container according to the present invention in an equilibrium position when the container is full.

FIG. 3A illustrates container A when full and in an upright position. The center of handle 28 is designated by cross 40. The center of gravity of this container when full is designated by CG cross 42. The lateral distance between these centers is designated by d2 which is approximately five and a quarter inches. FIG. 3*b* illustrates the equilibrium state when container A is rotated such that the center of gravity of the container is vertically aligned with the center of handle cross 40. Angle alpha two illustrates the tilting of container in this equilibrium position which is sufficient to enable items contained within container A to be dispensed without requiring further work by the person. Angle alpha two is approximately seventy-five degrees.

The mechanical advantage of container A in 3*a* and 3*b* versus the prior art in 2*a* and 2*b* results from the distance d2 being greater than d1 and hence providing a longer lever arm which enables more rotation to be made by the container when tilted around the fulcrum which is the center of the respective handle.

Figure 4A:
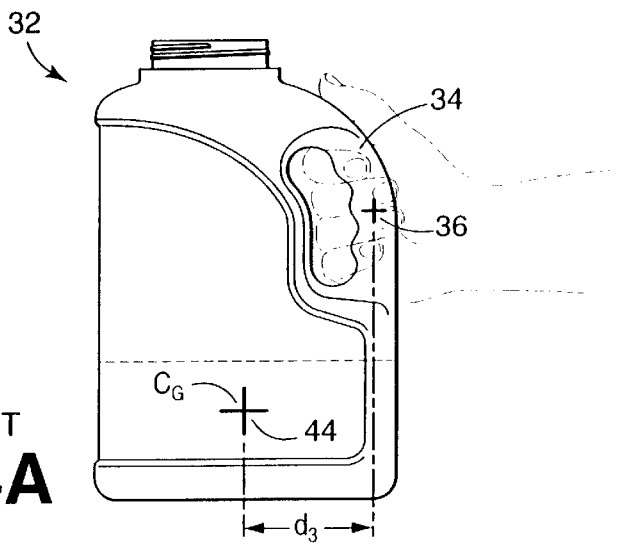
PRIOR ART FIG 4A
FIG. 4A illustrates a prior art container in an upright position when the container is only partially filled at a level below the handle.
Figure 4B:
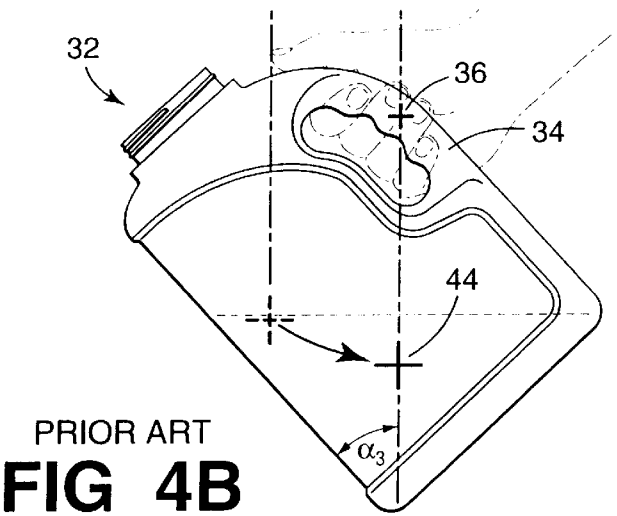
PRIOR ART FIG 4B
FIG. 4B illustrates a prior art container in an equilibrium position when the container is only partially filled at a level below the handle.
Figure 6:
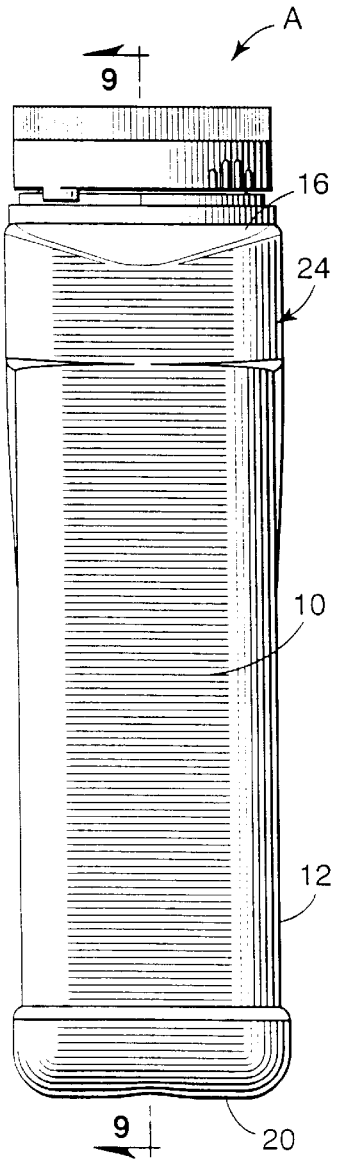
FIG. 6 illustrates a front view of a dispensing container according to the present invention.

FIG. 4A illustrates the prior art container 32 when containing particles below the handle and in an upright position. The center of handle 34 is designated by cross 36. The center of gravity of this container is designated by CG cross 44. The lateral distance between these centers is designated by d3 which is approximately four inches. FIG. 4*b* illustrates the equilibrium state when prior art container 32 is rotated such that the center of gravity of the container is vertically aligned with the center of handle 32. Angle alpha three illustrates the tilting of prior art container 342in this equilibrium position. Angle alpha three is approximately forty-three degrees. As is evident, further work is required by the person to rotate the container at a position where contained items may be dispensed.

Figure 5A:
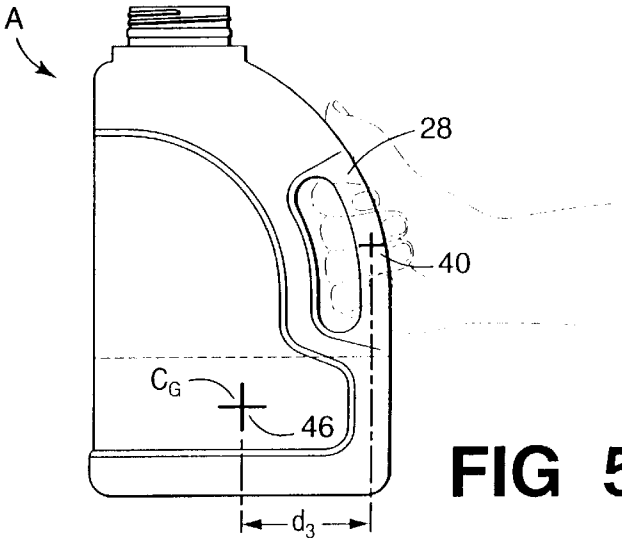
FIG. 5A illustrates a dispensing container according to the present invention in an upright position when the container is only partially filled at a level below the handle.
Figure 5B:
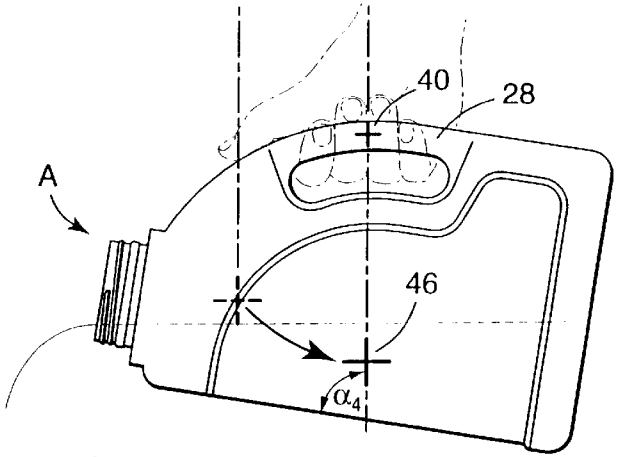
FIG. 5B illustrates a dispensing container according to the present invention in an equilibrium position when the container is only partially filled at a level below the handle.

FIG. 5A illustrates container A when only containing items below handle 28. The center of handle 28 is designated by cross 40. The center of gravity of this container with the particles below the handle is designated by CG cross 46. The lateral distance between these centers is designated by d3 which is the same distance as d3 in FIG. 4A. FIG. 5*b* illustrates the equilibrium state when container A is rotated such that the center of gravity of the container is vertically aligned with the center of handle 40. Angle alpha four illustrates the tilting of container in this equilibrium position which is sufficient to enable items contained within container A to be dispensed without requiring further work by the person. Angle alpha four is approximately eighty degrees.

The mechanical advantage of container A as shown in FIGS. 5*a* and 5*b* over the prior art exists even when the lateral distance between the center of the respective handles and the center of gravity of the containers are equal. This results because the center of handle 28 of container A is lower in vertical height with respect to the center of gravity of the container than the prior art which provides for a greater angle of rotation.

Thus, accordingly, it may be seen that an advantageous design of a container may be had according to the present invention which provides for a handle having a center which is positioned both in a vertical and horizontal location to provide a mechanical advantage to enable the container to easily be positioned in a dispensing position.

By advantageously locating the handle in a container construction wherein the handle encircles the center of gravity of a container when full and which is also relatively close to the center gravity of the container when containing articles below the bottom of the handle provides for a container which at equilibrium provides an optimum mechanical advantage resulting in the tilting of the container to an angle whereby the particles are dispensed and requiring either minimum or no work from the individual for dispensing the articles. While the optimum design of the handle for dispensing articles would be located at the base of the container, such a design is unsuitable for lifting since the weight of the container is not evenly balanced. As it may be seen the construction of the container according to the present invention provides both ease in lifting and also in dispensing container articles.

What is claimed is:

1. A dispensing container for containing and dispensing large quantities of articles, wherein said dispensing container comprises:

a primary body having a front side, rear side, left side, right side, and bottom;

said primary body having a general height;

a handle integrally formed within said primary body, said handle being offset from said primary body defining a void;

said handle encircling the center of gravity of said primary body when said primary body is full of contained articles and wherein the center of said handle is at a height generally parallel to the center of the height of said primary body; and wherein said primary body at equilibrium rotates at a general angle of approximately seventy-five degrees around the center of said handle when said primary body is full.

2. The container of claim 1 wherein said primary body may rotate at equilibrium around the center of said handle at an angle of eighty degrees when said primary body contains articles at a height below the base of said handle.

* * * * *